US012263415B2

(12) United States Patent
Kamiyama

(10) Patent No.: US 12,263,415 B2
(45) Date of Patent: Apr. 1, 2025

(54) TOY FOR FIGURE PLAY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 226 days.

(21) Appl. No.: 17/978,471

(22) Filed: Nov. 1, 2022

(65) Prior Publication Data

US 2023/0139900 A1 May 4, 2023

(30) Foreign Application Priority Data

Nov. 2, 2021 (JP) ..... 2021-179540

(51) Int. Cl.

| | |
|---|---|
| ***A63H 3/52*** | (2022.01) |
| ***A63H 3/16*** | (2006.01) |
| ***A63H 3/50*** | (2006.01) |
| ***A63H 33/42*** | (2006.01) |

(52) U.S. Cl.

CPC ..... *A63H 3/50* (2013.01); *A63H 3/16* (2013.01)

(58) Field of Classification Search

CPC ... A63H 3/16; A63H 3/50; A63H 3/52; A63H 33/42; A63H 33/00; A63H 33/30; A63H 13/20; A63G 1/28

USPC ..... 446/227, 236, 268, 322, 330, 238; 472/29, 32, 33

See application file for complete search history.

(56) References Cited

U.S. PATENT DOCUMENTS

| | | | | | |
|---|---|---|---|---|---|
| 1,641,707 | A * | 9/1927 | Strigl | A63G 1/28 | 472/10 |
| 3,191,930 | A * | 6/1965 | Cottrell | A63G 1/30 | 472/12 |
| 3,897,054 | A * | 7/1975 | Riggs | A63H 13/20 | 472/12 |
| 4,428,576 | A * | 1/1984 | Fisher, Jr. | A63G 1/22 | 472/33 |
| 4,476,649 | A * | 10/1984 | Zaruba | A63H 7/04 | 446/411 |
| 4,753,436 | A * | 6/1988 | Sinclair | A63H 13/20 | 472/12 |
| 4,904,220 | A * | 2/1990 | Williams | A63H 33/006 | 446/236 |
| 4,925,182 | A * | 5/1990 | Hou | A63H 13/20 | 472/12 |

(Continued)

FOREIGN PATENT DOCUMENTS

JP 2525505 Y2 2/1997

*Primary Examiner* — Alexander R Niconovich

(74) *Attorney, Agent, or Firm* — Faegre Drinker Biddle & Reath LLP

(57) ABSTRACT

A toy for figure play includes: a shaft portion; a rotating body; and a suspension body. The rotation body includes: a bearing portion supported by the shaft portion so as to be rotatable in a circumferential direction of the rotating body around the shaft portion; a suspension portion; and a protrusion portion provided on an outer side than the suspension portion in a radial direction of the rotating body. The suspension body includes: a suspension connecting portion connected to the suspension portion to allow the suspension body to swing at least in the radial direction; a figure placement portion; and an abutting portion configured to be allowed to abut with the protrusion portion.

6 Claims, 7 Drawing Sheets

(56) References Cited

U.S. PATENT DOCUMENTS 5,078,386 A * 1/1992 Hou ..... A63H 13/20 472/7
5,203,743 A * 4/1993 Hou ..... A63H 13/20 472/12
5,276,271 A * 1/1994 Huang ..... A63H 13/20 D11/158
5,412,889 A * 5/1995 Hou ..... G09F 19/08 84/95.2
5,556,318 A * 9/1996 So ..... A63H 13/20 446/236
5,640,791 A * 6/1997 Fong ..... G09F 19/08 40/414
5,810,641 A * 9/1998 Lo ..... A63G 19/20 446/366
5,986,189 A * 11/1999 Yang ..... A63H 13/20 472/12
6,168,494 B1 * 1/2001 Engel ..... A63H 33/42 446/484
6,193,581 B1 * 2/2001 Wiggs ..... A63H 33/42 446/330
6,582,273 B2 * 6/2003 Chen ..... A63H 5/00 446/175
6,764,375 B1 * 7/2004 Hsu ..... A63H 13/20 446/236
6,775,938 B2 * 8/2004 Lanci ..... G09F 19/02 40/473
7,597,605 B2 * 10/2009 Yang ..... G09F 19/02 40/406
7,938,730 B2 * 5/2011 Richardson ..... A63G 1/28 472/39
9,138,655 B2 * 9/2015 Yeung ..... A63H 33/42
2002/0165062 A1 * 11/2002 Huang ..... A63H 13/20 475/331
2003/0159320 A1 * 8/2003 Lanci ..... G09F 15/0087 40/493

* cited by examiner

TOY FOR FIGURE PLAY

CROSS-REFERENCE TO RELATED APPLICATIONS

This application is based on and claims priority under 35 USC 119 from Japanese Patent Application No. 2021-179540 filed on Nov. 2, 2021, the contents of which are incorporated herein by reference.

TECHNICAL FIELD

The present disclosure relates to a toy for figure play which can be played together with a figure by presenting configurations matching various imaginary scenes.

BACKGROUND ART

In the related art, there is a toy for figure play which allows figure play by presenting configurations matching various imaginary scenes. For example, JP2525505Y2 discloses a store toy as a toy for figure play disclosed including, on a main body in a form of a store, a rotating merchandise display part provided with an endless belt on which hangers are provided at predetermined intervals. The endless belt can be rotated by a rotating member. With the toy for figure play, a child who is a user can hang clothes for a figure on the hangers and play with the figure as if buying clothes at a clothing store.

SUMMARY OF INVENTION

A situation in which the rotating member is manually rotated and the clothes hung on the hangers are moved in a shaking manner is enjoyed by the child who is the user. However, for example, an infant who has difficulty in adjusting a rotating operation of the rotating member may vigorously rotate the rotating member, and the hangers or clothes hung on the hangers may collide with a member of the store main body around the endless belt. In such a case, the members that collide with each other may be damaged, and the enjoyment of play may be impaired.

An object of the present disclosure is to provide a toy for figure play that can be played with fun while reducing damage to a member.

The present disclosure provides a toy for figure play including: a shaft portion; a rotating body including: a bearing portion supported by the shaft portion so as to be rotatable in a circumferential direction of the rotating body around the shaft portion; a suspension portion; and a protrusion portion provided on an outer side than the suspension portion in a radial direction of the rotating body; and a suspension body including: a suspension connecting portion connected to the suspension portion to allow the suspension body to swing at least in the radial direction; a figure placement portion; and an abutting portion configured to be allowed to abut with the protrusion portion.

According to the above aspect, a toy for figure play that can be played with fun while reducing damage to a member can be provided.

DESCRIPTION OF EMBODIMENTS

Figure 1:
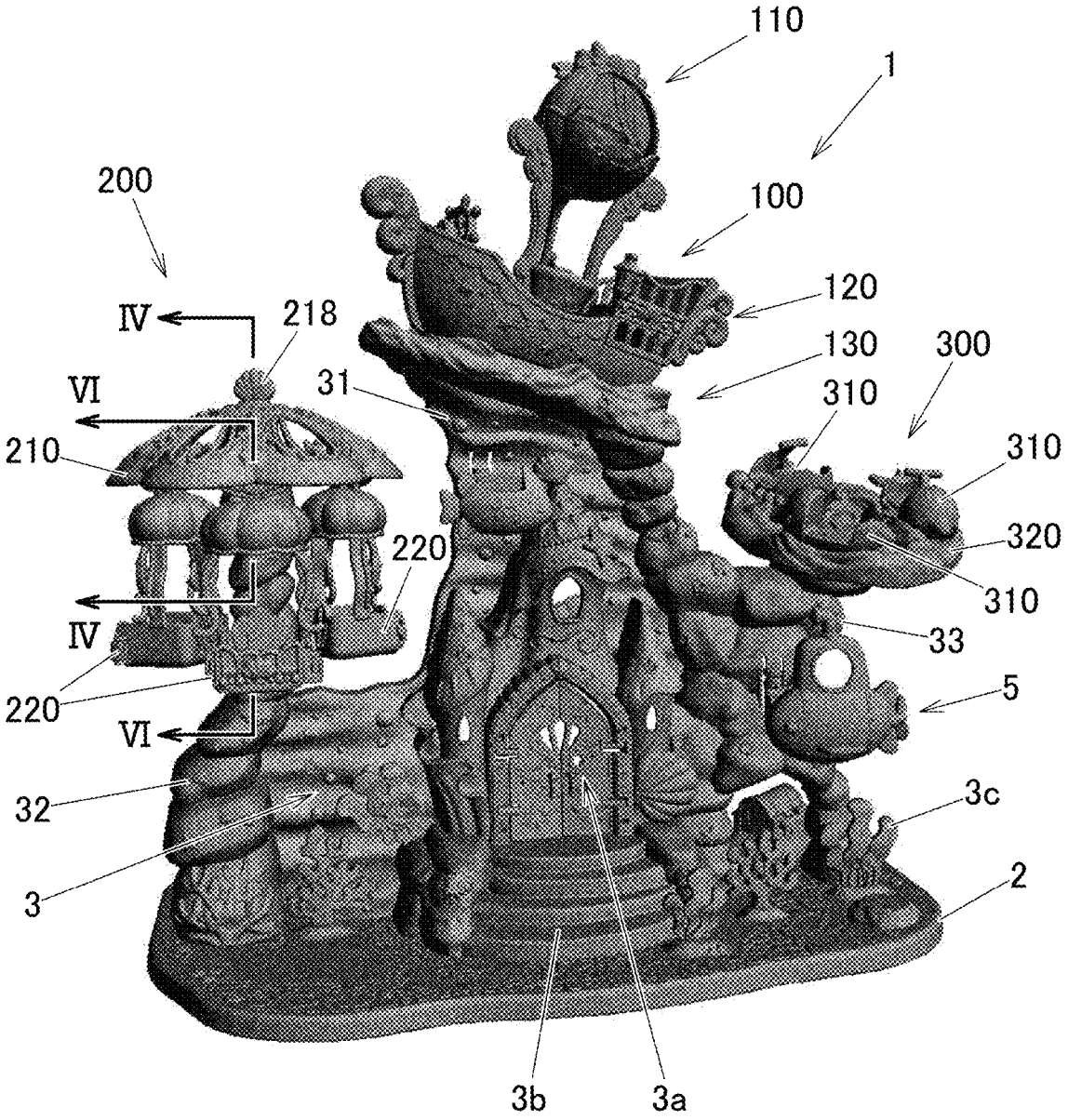
FIG. 1 is an overall perspective view of a toy for figure play according to an embodiment of the present disclosure.

An embodiment of the present disclosure will be described with reference to the drawings. FIG. 1 is a view showing a toy for figure play 1 resembling an undersea castle as viewed from front. The toy for figure play 1 includes a figure toy main body 5 including a plate-shaped base portion 2 to be placed on a floor or the like and a support main body portion 3 provided on the base portion 2. The support main body portion 3 includes a central support plate 31 formed to be high, and a first playing portion 100 serving as a playing portion is provided on a top of the central support plate 31. The first playing portion 100 is detachably provided with a ship 120 including a balloon portion 110. In the support main body portion 3 below the first playing portion 100, a door 3*a* and stairs 3*b* resembling the castle, and seaweed 3*c* at predetermined positions are provided. In the toy for figure play 1, a part below a corrugated wave portion 130 at a central top portion of the support main body portion 3 on which the ship 120 is placed resembles a castle on a seabed. The toy for figure play 1 is set to be played with a figure (not shown) whose height is smaller than a height of the door 3*a*, for example, about ⅔ of the height of the door 3*a*.

As seen in FIG. 1, a second playing portion 200 is provided on an upper portion of a support post 32 on a left side of the support main body portion 3, and a third playing portion 300 is provided on an upper portion of a branch-shaped support portion 33 extending in a branch shape on a right side of the support main body portion 3. The second playing portion 200 includes a rotating body 210 and three suspension bodies 220 which are suspended from the rotating body 210 and on which figures can be placed. The rotating body 210 is a playing portion that can be manually rotated and enjoyed by swinging the suspension bodies 220 on which the figures are placed. The third playing portion 300 includes a rotating body 320 provided with three figure holders 310 in forms of a crab, a dolphin, and a fish. The figure holder 310 can hold a figure. By holding a figure in the figure holder 310 and manually rotating the rotating body 320, the user can play merry-go-round in the third playing portion 300.

Figure 2:
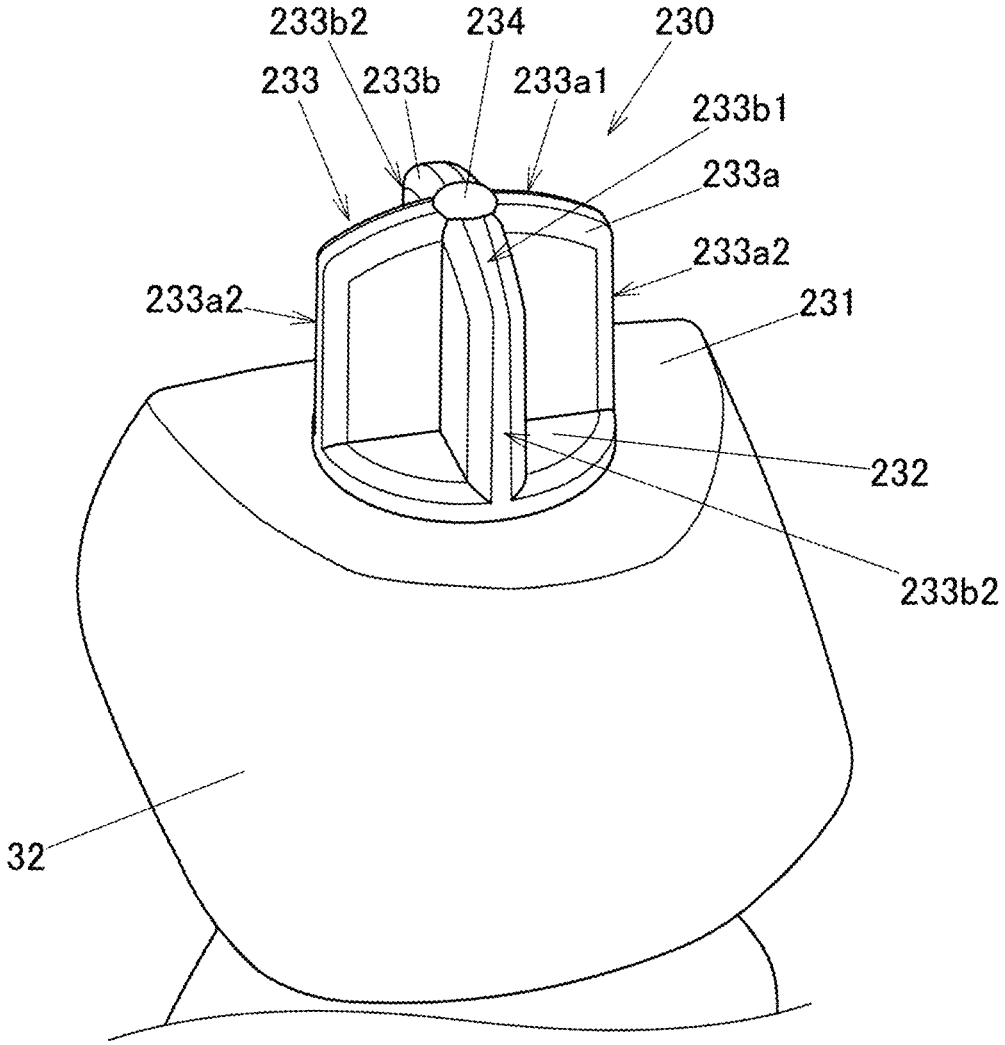
FIG. 2 is a perspective view of a shaft portion of the toy for figure play according to the embodiment of the present disclosure.

Next, the second playing portion 200, which is a main part of the present disclosure, will be described in detail with reference to FIGS. 2 to 7. FIG. 2 shows a shaft portion 230 provided at a top portion of the support post 32 of the support main body portion 3. A bearing portion 211 (see FIG. 3) of the rotating body 210 is rotatably engaged with the shaft portion 230.

The shaft portion 230 has a cross-shaped leg portion 233 erected in a cross shape with a disk-shaped portion 232 protruding from a flat surface portion 231 formed at the top portion of the support post 32 interposed. The cross-shaped leg portion 233 includes plate portions 233*a* and 233*b* orthogonal to each other. Upper surfaces 233*a*1 and 233*b*1 of the plate portions 233*a* and 233*b* are formed in a convex arc shape having an intersection portion as a top portion. Outer peripheral surfaces 233*a*2 of the plate portion 233*a* are provided at two positions facing each other, outer peripheral surfaces 233*b*2 of the plate portion 233*b* are provided at two positions facing each other, and the outer peripheral surfaces 233*a*2 and 233*b*2 are formed in a convex arc shape in a top view. A shaft support point portion 234 is provided at a portion of the cross-shaped leg portion 233 at which the plate portions 233*a* and 233*b* intersect with each other. An upper surface of the shaft support point portion 234 is formed in a substantially convex spherical shape.

Figure 3:
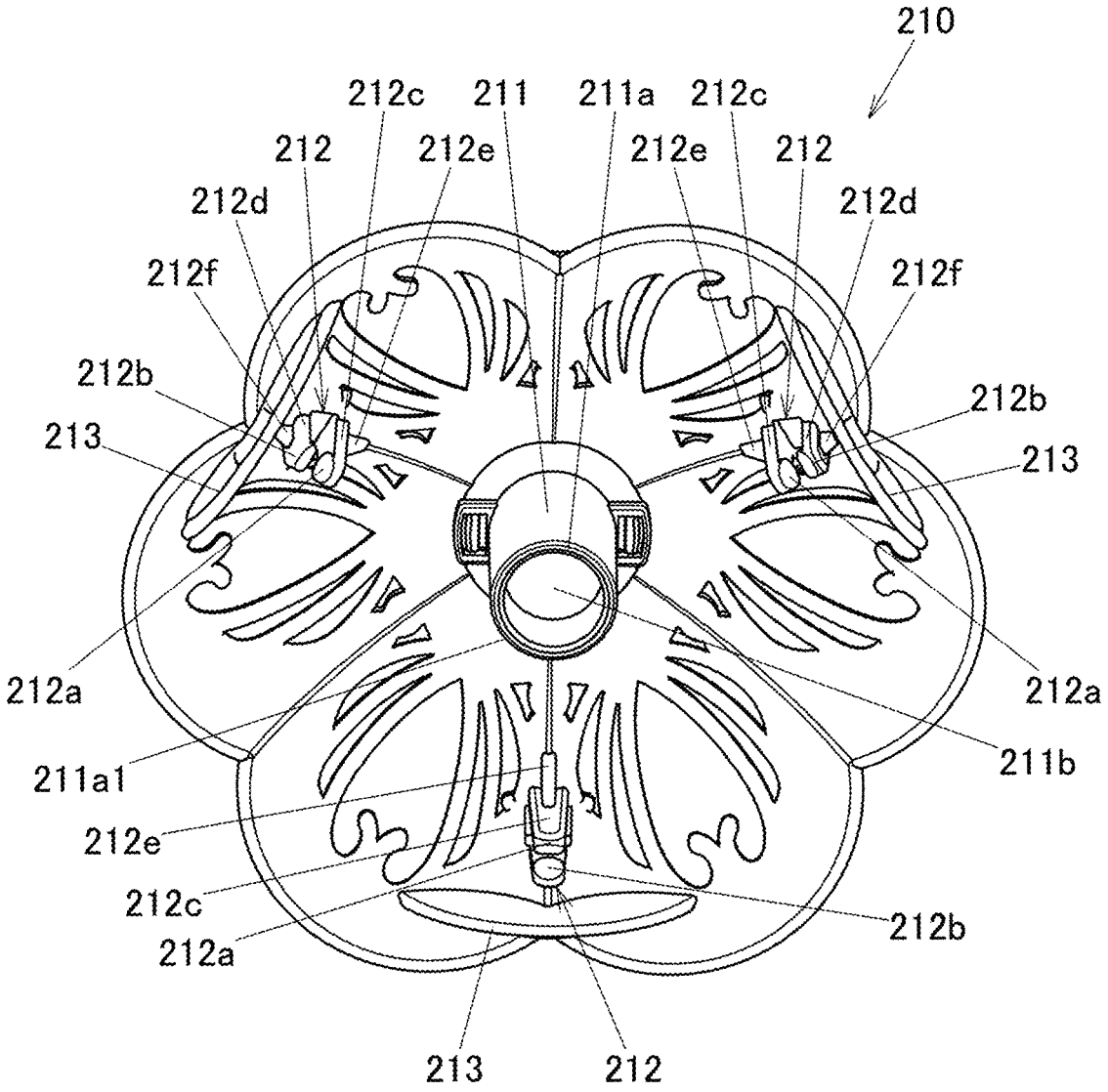
FIG. 3 is a perspective view of a rotating body of the toy for figure play according to the embodiment of the present disclosure as viewed from below.

FIG. 3 is a perspective view of the rotating body 210 as viewed from below. The rotating body 210 is formed in an umbrella shape, has a decorative shape opening opened from a front surface side to a back surface side, and a shell-shaped decorative piece 218 (see FIGS. 1 and 4) is provided at an central upper portion on the front surface side. The cylindrical bearing portion 211 is provided at a central portion on the back surface side. The bearing portion 211 includes a cylindrical portion 211*a* and a shaft-supported surface portion 211*b* having a concave spherical shape, which is a bottom portion of the cylindrical portion 211*a*.

Figure 4:
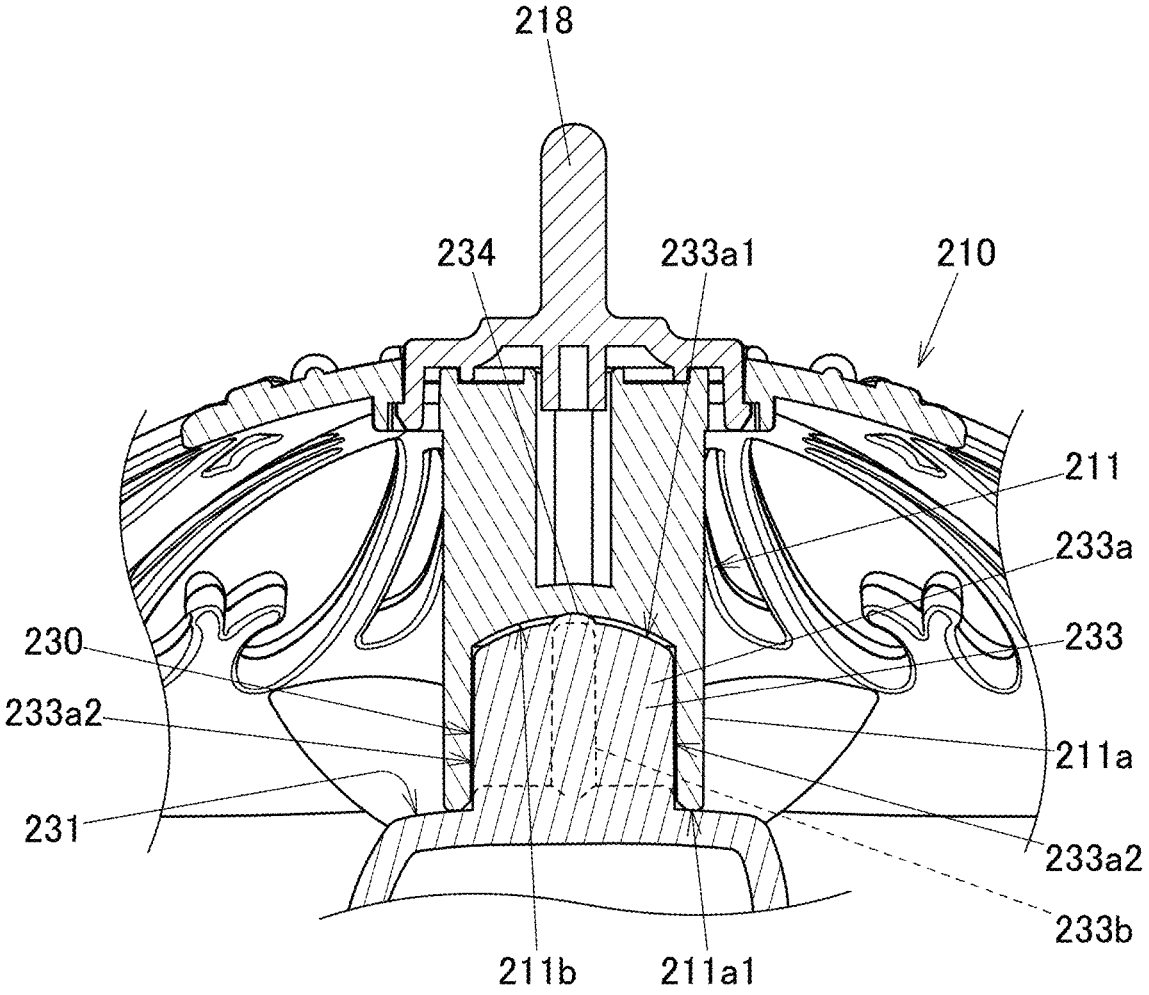
FIG. 4 is an enlarged cross-sectional view taken along a line IV-IV in FIG. 1 and showing an engaged state of a bearing portion and the shaft portion of the toy for figure play according to the embodiment of the present disclosure.

As shown in FIG. 4, the cross-shaped leg portion 233 is inserted into the cylindrical portion 211*a* of the bearing portion 211. The bearing portion 211 is rotatably supported by the shaft portion 230, and the rotating body 210 is rotatable around an axis of the bearing portion 211. More specifically, the substantially convex spherical upper surface of the shaft support point portion 234 is abutted with the substantially concave spherical shaft-supported surface portion 211*b* to support the rotating body 210. Further, an end edge portion 211*a*1, which is a tip end portion of the cylindrical portion 211*a*, is provided in the vicinity of or to contact the flat surface portion 231 to allow the end edge portion 211*a*1 to sliding contact the flat surface portion 231. Then, an inner peripheral surface of the cylindrical portion 211*a* is in sliding contact with the outer peripheral surfaces 233*a*2 and 233*b*2 of the cross-shaped leg portion 233.

In this way, the rotating body 210 is rotatable due to the shaft support point portion 234 and the shaft-supported surface portion 211*b*, which are spherical surfaces. Here, a curvature of the convex spherical shape of the shaft support point portion 234 is larger than a curvature of the concave spherical shape of the shaft-supported surface portion 211*b*. Therefore, since the rotating body 210 is supported at one point on the upper surface of the shaft support point portion 234, frictional resistance is reduced, and the rotating body 210 can be rotated with a small force. Then, the end edge portion 211*a*1 of the cylindrical portion 211*a* is in sliding contact with the flat surface portion 231, the inner peripheral surface of the cylindrical portion 211*a* is in sliding contact with the outer peripheral surfaces 233*a*2 and 233*b*2 of the cross-shaped leg portion 233, and thus the rotating body 210 can rotate smoothly without rattling.

Referring back to FIG. 3, three suspension portions 212 and three protrusion portions 213 are provided radially with respect to an axis on a back surface of the rotating body 210. The suspension portion 212 is provided with suspension shaft portions 212*a* and 212*b* that face each other at a predetermined interval in a radial direction in a rotation direction of the rotating body 210. The suspension shaft portions 212*a* and 212*b* are each formed in a substantially columnar shape, and are disposed such that axes thereof are in the radial direction in the rotation direction of the rotating body 210. The suspension shaft portions 212*a* and 212*b* are chamfered in a C-chamfered shape on lower sides of surfaces thereof facing each other. The suspension shaft portion 212*a* is provided on a radially inner side in the radial direction in the rotation direction of the rotating body 210, and the suspension shaft portion 212*b* is provided on a radially outer side. The suspension shaft portions 212*a* and 212*b* are respectively provided at tip end portions of plate-shaped suspension shaft support plates 212*c* and 212*d* erected from the back surface of the rotating body 210. The suspension shaft support plates 212*c* and 212*d* are respectively supported by ribs 212*e* and 212*f*.

On an outer side of the suspension portions 212 (on the radially outer side of the suspension portions 212 in the rotation direction of the rotating body 210), the protrusion portions 213 are provided corresponding to the suspension portions 212. The protrusion portion 213 is formed in an arc plate shape.

Figure 5:
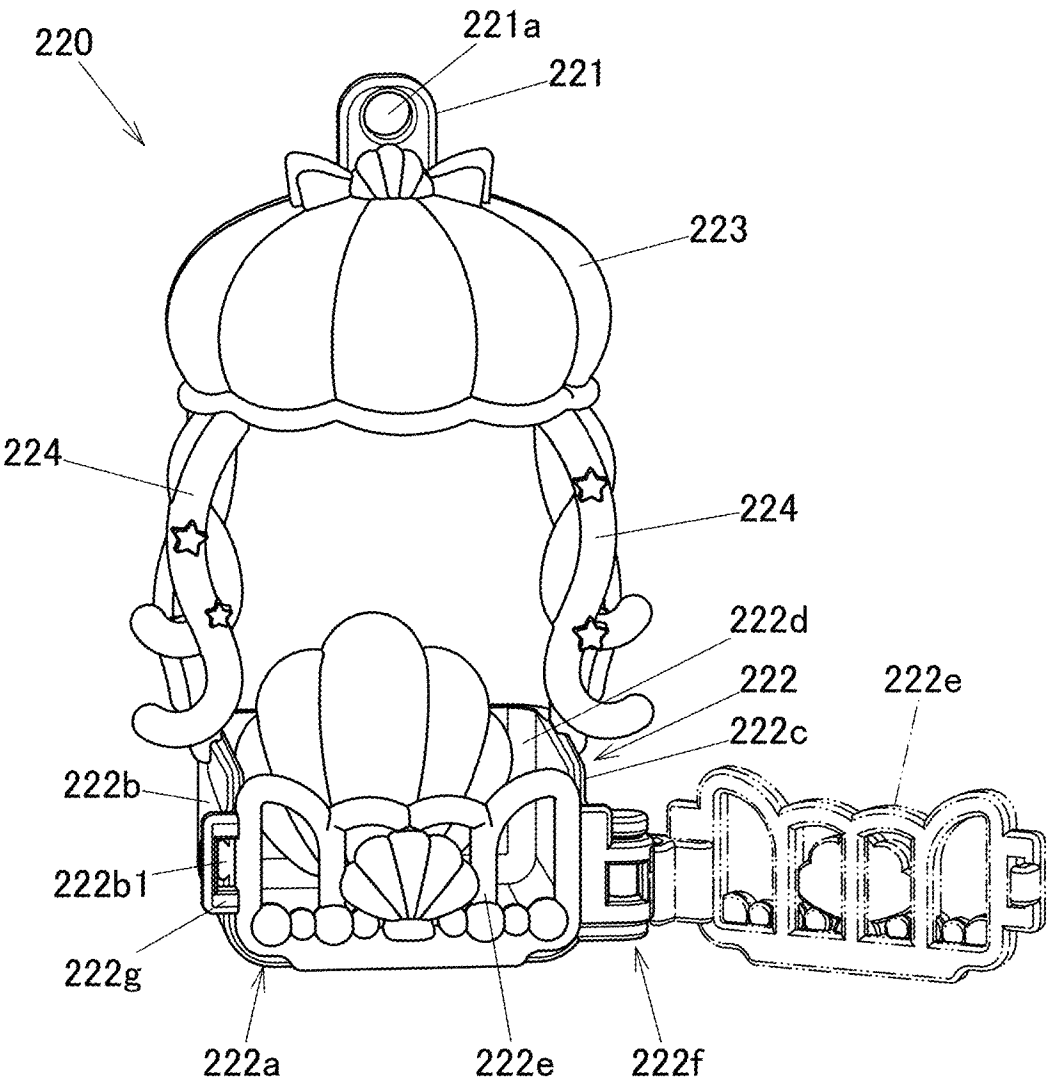
FIG. 5 is a perspective view showing a suspension body of the toy for figure play according to the embodiment of the present disclosure.

As shown in FIG. 5, the suspension body 220 includes a basket-shaped figure placement portion 222 and an umbrella-shaped abutting portion 223. The figure placement portion 222 includes a bottom plate 222*a*, side plates 222*b* and 222*c* erected from the bottom plate 222*a* so as to face each other, and a back plate 222*d* erected from the bottom plate 222*a* so as to connect the side plates 222*b* and 222*c*. Further, the figure placement portion 222 includes an opening and closing door 222*e* at a position facing the back plate 222*d*. The opening and closing door 222*e* has one end portion connected to the side plate 222*c* via a hinge portion 222*f* so as to be openable and closable. A frame-shaped opening lock portion 222*g* is provided at the other end portion of the opening and closing door 222*e*, and by inserting a protrusion 222*b*1 of the side plate 222*b* into the opening lock portion 222*g*, the opening and closing door 222*e* can be locked with a click feeling. A figure can be placed on the bottom plate 222*a* of the figure placement portion 222.

A suspension connecting portion 221 is erected from a substantially central upper portion of the abutting portion 223. The suspension connecting portion 221 is formed in a substantially plate shape and has a hole portion 221*a*. The side plates 222*b* and 222*c* of the figure placement portion 222 and the abutting portion 223 are connected to each other by two vertically elongated connecting portions 224 which extend upward from the side plates 222*b* and 222*c*, respectively.

Figure 6:
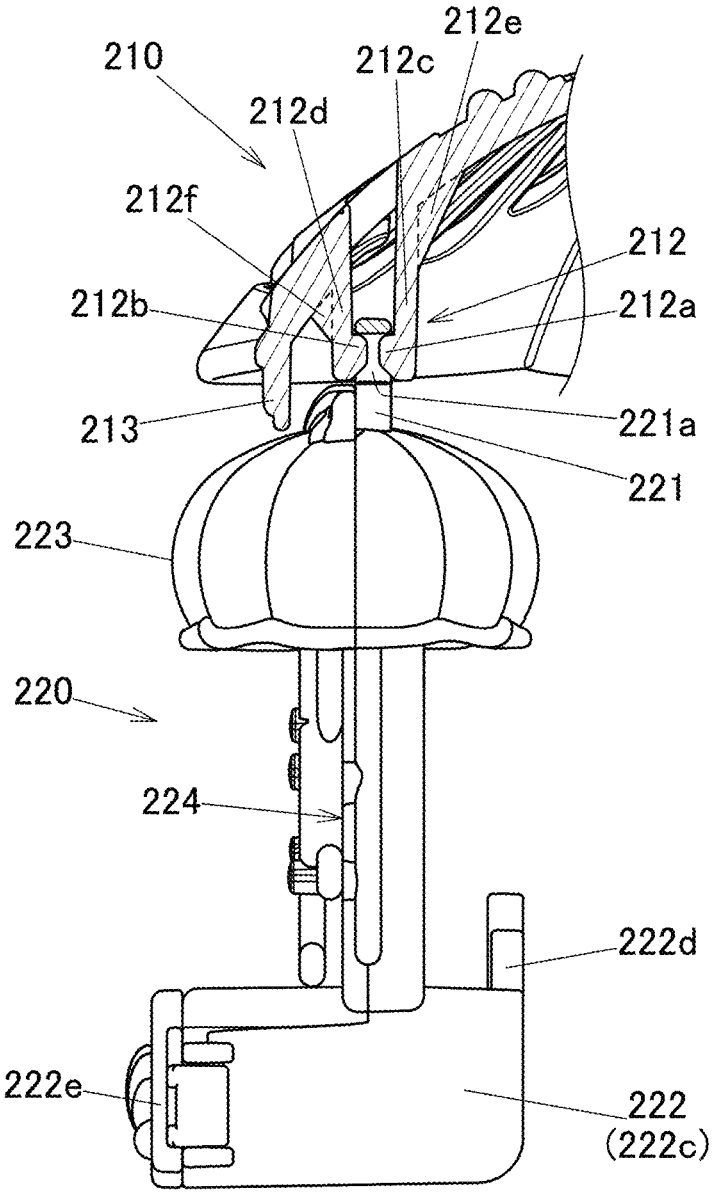
FIG. 6 is cross-sectional view taken along a line VI-VI in FIG. 1 and showing a state in which a suspension connecting portion of the suspension body is connected to a suspension portion of the rotating body in the toy for figure play according to the embodiment of the present disclosure.

As shown in FIG. 6, the suspension connecting portion 221 of the suspension body 220 is inserted from the chamfered portions of the suspension shaft portions 212*a* and 212*b* in the suspension portion 212, and the suspension shaft portions 212*a* and 212*b* are loosely fitted in the hole portion 221*a*. Thus, the suspension body 220 is swingable in the radial direction of the rotation of the rotating body 210 (a left-right direction when viewed in FIG. 6), and is swingable around axes of the suspension shaft portions 212*a* and 212*b*.

That is, due to the rotation of the rotating body 210, the suspension body 220 rotates around an axis of the shaft portion 230 (bearing portion 211) while swinging in left-right and front-rear directions from the view of a figure facing a front toward an opening and closing door 222*e* side. Therefore, the user can play while imagining that the figure is enjoying rotation swing play.

Figure 7:
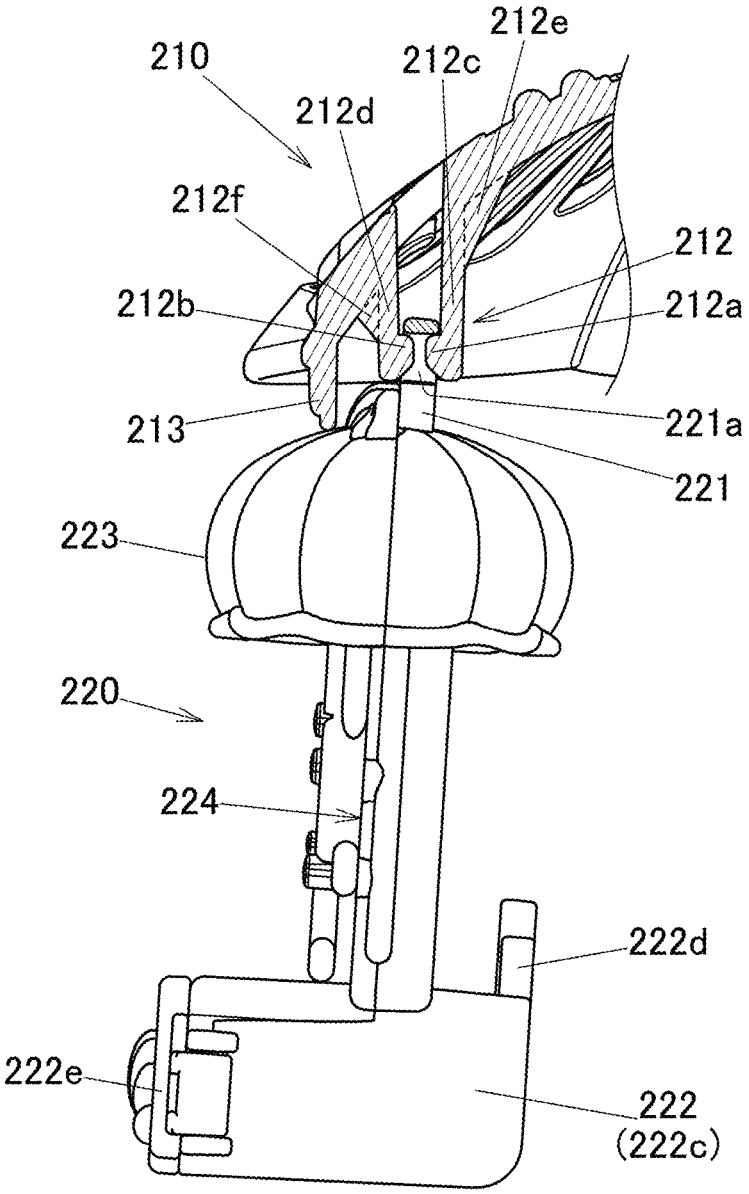
FIG. 7 is a cross-sectional view corresponding to a cross section taken along a line VI-VI in FIG. 1, and showing a state in which the suspension body is swung in a radially outward direction of rotation of the rotating body by a centrifugal force in the toy for figure play according to the embodiment of the present disclosure.

Here, the rotating body 210 can be rotated by rotating the decorative piece 218 by hands. Then, when the rotating body 210 is rotated vigorously, as shown in FIG. 7, tip end portions of the protrusion portions 213 are abutted with corresponding portions on surfaces of the abutting portion 223, and swinging of the suspension body 220 toward a radially outward direction of the rotation of the rotating body 210 due to a centrifugal force is restricted. Therefore, even for an infant who has difficulty in adjusting the rotation of the rotating body 210, stop of the rotation of the rotating body 210 or damage to members due to collision of the toy for figure play 1 with another member (the central support plate 31 in the present embodiment) when the suspension body 220 swings toward the radially outer direction of the rotation of the rotating body 210 due to the centrifugal force is reduced.

As described above, since at least the suspension body 220 that swings in the radial direction of the rotation of the rotating body 210 is less likely to collide with other members, the second playing portion 200 can be provided close to the central support plate 31 without forming the toy for figure play 1 large to avoid collision between the swinging suspension body 220 and the central support plate 31. Therefore, a degree of freedom in design, such as disposing the playing portion close to the center, can be increased and the design of the toy for figure play 1 can be improved.

Further, since the protrusion portion 213 of the rotating body 210 is formed in a convex arc plate shape, even when the suspension body 220 swings around the axes of the suspension shaft portions 212*a* and 212*b*, swinging motion can be enjoyed without restricting the swinging motion.

According to the embodiment of the present disclosure as described above, it is possible to provide a toy for figure play of the following aspects.

A toy for figure play according to a first aspect includes: a shaft portion; a rotating body including: a bearing portion supported by the shaft portion so as to be rotatable in a circumferential direction of the rotating body around the shaft portion; a suspension portion; and a protrusion portion provided on an outer side than the suspension portion in a radial direction of the rotating body; and a suspension body including a suspension connecting portion connected to the suspension portion to allow the suspension body to swing at least in the radial direction; a figure placement portion; and an abutting portion configured to be allowed to abut with the protrusion portion.

According to the configuration, even when the rotating body is rotated and the suspension body swings to the radially outer side of the rotation of the rotating body, a swing angle of the suspension body can be appropriately regulated, so that collision of the suspension body with another playing portion, a support portion supporting the playing portion, or the like can be reduced. Therefore, a toy for figure play that can also be played by an infant who has difficulty in adjusting a force with fun while reducing damage to a member can be provided.

In the toy for figure play according to a second aspect, the shaft portion includes: a cross-shaped leg portion having a cross shape and erected from a flat surface portion, the cross-shaped leg portion including an upper surface having an arc shape; and a shaft support point portion protruding from an intersection portion of the upper surface of the cross-shaped leg portion, the shaft support point portion having a convex spherical shape, and the bearing portion includes: a cylindrical portion including and end edge portion configured to sliding contact the flat surface portion and an inner peripheral surface configured to sliding contact an outer peripheral surface of the cross-shaped leg portion; and a shaft-supported surface portion having a concave spherical shape and provided on a bottom portion of the cylindrical portion, the shaft-supported surface portion being configured to be abutted with the shaft support point portion.

According to the configuration, the cylindrical portion of the bearing portion of the rotating body is guided in the rotation direction by the outer peripheral surface of the cross-shaped leg portion and the flat surface portion, and the rotating body is spherically supported by the shaft support point portion of the cross-shaped leg portion of the shaft portion and the bottom portion of the cylindrical portion, so that rattling can be reduced and the rotating body can be rotated smoothly.

In the toy for figure play according to a third aspect, the suspension portion includes a suspension shaft portion having an axis extending in the radial direction, and the suspension connecting portion has a hole portion in which the suspension shaft portion is loosely fitted.

According to the configuration, the suspension body is rotated by the rotating body while swinging not only in the front-rear direction but also in the left-right direction with respect to a figure placed in the suspension body, so that the child can further enjoy playing.

In the toy for figure play according to a fourth aspect, the figure placement portion include an opening and closing door and is formed in a basket shape, the abutting portion is formed in an umbrella shape, and the suspension connecting portion protrudes from a central upper portion of the abutting portion, and the suspension body includes two elongated connecting portions which connect side portions of the figure placement portion and the abutting portion and which are long in an upper-lower direction.

According to the configuration, since the suspension body can be formed as a figure placement portion hanging from the abutting portion having a shape such as an umbrella via the connecting portions, the design can further enhance an imaginary scene for a child playing with figures.

In the toy for figure play according to a fifth aspect, the shaft portion is provided on a main body of the toy for figure play including a plurality of playing portions.

According to the configuration, since the playing portion including the rotating body and the suspension body can be provided in the main body of the toy for figure play including a plurality of playing portions, collision of the suspension body with other members can be reduced, and thus the playing portions can be provided close to each other, and a toy for figure play having a high degree of freedom in design can be provided.

In the toy for figure play according to a sixth aspect, the protrusion portion protrudes downward from the rotating body, and the abutting portion is positioned below a tip end of the protrusion portion.

According to the configuration, when the rotating body is rotated vigorously, the tip end of the protrusion portion is abutted with the abutting portion, and swinging of the suspension body toward a radially outward direction of the rotating body due to a centrifugal force is restricted.

Although the embodiment of the present disclosure have been described above, the present disclosure is not limited to the above-described embodiment, and various modifications can be made without departing from the scope of the present invention. For example, although three suspension bodies 220 are provided in one rotating body 210 in the present embodiment, the number of suspension bodies 220 may be one or two or more. Further, the suspension body 220 may swing only in the front-rear direction of a figure to be placed.

What is claimed is:

1. A toy for figure play comprising:

a shaft portion;

a rotating body comprising:

a bearing portion supported by the shaft portion so as to be rotatable in a circumferential direction of the rotating body around the shaft portion;

a suspension portion; and a protrusion portion provided outside of the suspension portion in a radial direction of the rotating body; and a suspension body comprising:

a suspension connecting portion connected to the suspension portion to allow the suspension body to swing at least in the radial direction;

a figure placement portion; and an abutting portion configured to be allowed to abut with the protrusion portion.

2. The toy for figure play according to claim 1, wherein the shaft portion comprises:

a cross-shaped leg portion having a cross shape and erected from a flat surface portion, the cross-shaped leg portion including an upper surface having an arc shape; and a shaft support point portion protruding from an intersection portion of the upper surface of the cross-shaped leg portion, the shaft support point portion having a convex spherical shape, and wherein the bearing portion comprises:

a cylindrical portion including an end edge portion configured to be in sliding contact with the flat surface portion and an inner peripheral surface configured to be in sliding contact with an outer peripheral surface of the cross-shaped leg portion; and a shaft-supported surface portion having a concave spherical shape and provided on a bottom portion of the cylindrical portion, the shaft-supported surface portion being configured to be abutted with the shaft support point portion.

3. The toy for figure play according to claim 1, wherein the suspension portion comprises a suspension shaft portion having an axis extending in the radial direction, and wherein the suspension connecting portion has a hole portion in which the suspension shaft portion is loosely fitted.

4. The toy for figure play according to claim 1, wherein the figure placement portion comprises an opening and closing door and is formed in a basket shape, wherein the abutting portion is formed in an umbrella shape, and the suspension connecting portion protrudes from a central upper portion of the abutting portion, and wherein the suspension body comprises two elongated connecting portions which connect side portions of the figure placement portion and the abutting portion and which are long in an upper-lower direction.

5. The toy for figure play according to claim 1, wherein the shaft portion is provided on a main body of the toy for figure play, the main body comprising a plurality of playing portions.

6. The toy for figure play according to claim 1, wherein the protrusion portion protrudes downward from the rotating body, and wherein the abutting portion is positioned below a tip end of the protrusion portion.

* * * * *